United States Patent [19]

Fenley

[11] Patent Number: 4,830,065

[45] Date of Patent: May 16, 1989

[54] WIRE SPLICING TOOL

[76] Inventor: Thomas D. Fenley, 1500 Branch Rd., Perkasie, Pa. 18944

[21] Appl. No.: 20,576

[22] Filed: Mar. 2, 1987

[51] Int. Cl.[4] ..... B21F 15/04

[52] U.S. Cl. ..... 140/118

[58] Field of Search ..... 140/52, 117, 118, 120, 140/121

[56] References Cited

U.S. PATENT DOCUMENTS

| | | | |
|---|---|---|---|
| 395,642 | 1/1889 | Wulbecke | 140/117 |
| 471,419 | 3/1892 | Dickey | 140/117 |
| 533,066 | 1/1895 | Kent | 140/52 |
| 1,038,052 | 9/1912 | Wolf | 140/117 |

FOREIGN PATENT DOCUMENTS

| | | | |
|---|---|---|---|
| 518173 | 11/1955 | Canada | 140/118 |
| 736182 | 11/1932 | France | 140/117 |

*Primary Examiner*—Lowell A. Larson

*Attorney, Agent, or Firm*—Joseph W. Molasky & Assocs.

[57] ABSTRACT

A wire splicing tool for splicing together the ends of single or multiple strand wires, such as the wire used for fence lines, includes a pair of tool members adapted to be set in an interlocked position capturing a straight portion at the end of a first wire extending along a fence line and holding a turned portion at the end of a second wire extending along the fence line for winding the second wire turned portion around the first wire straight portion to effect a splicing action between the two wires.

12 Claims, 3 Drawing Sheets

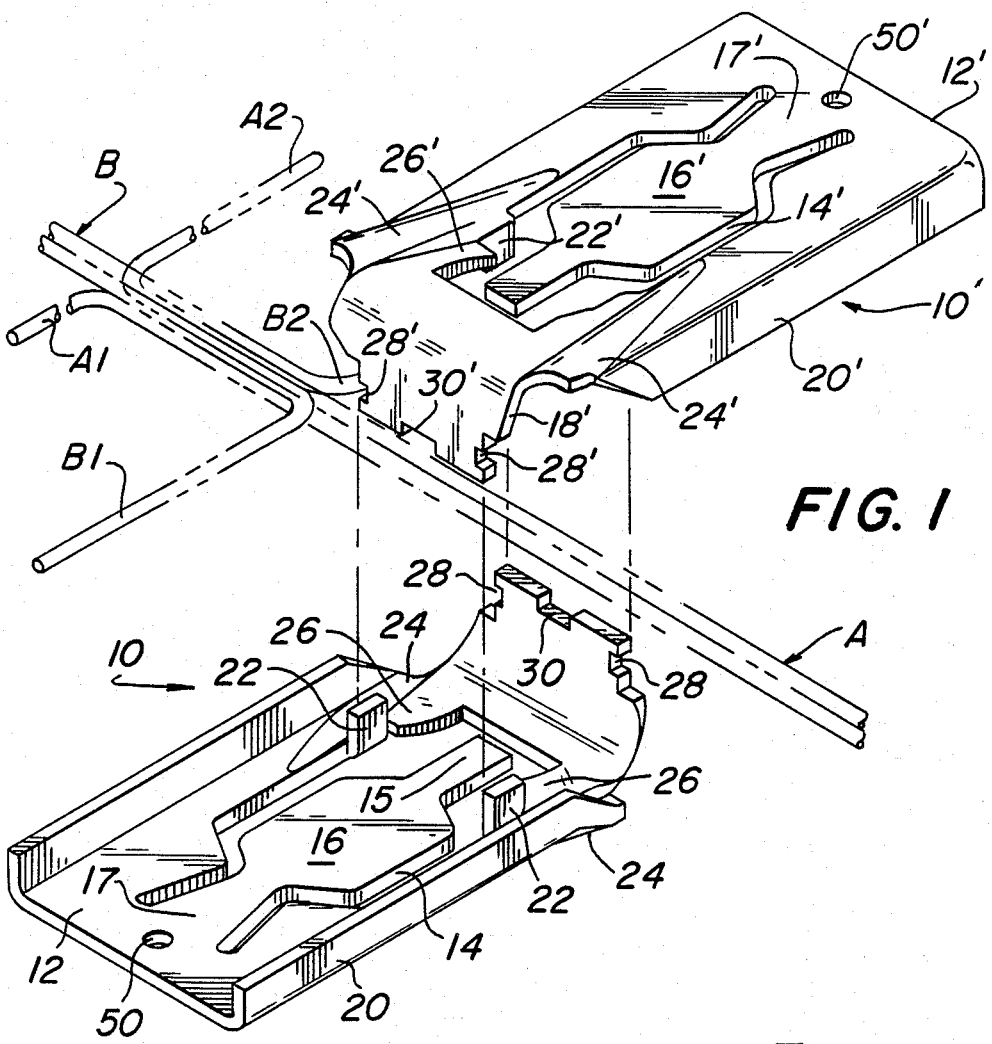
FIG. 1
FIG. 10
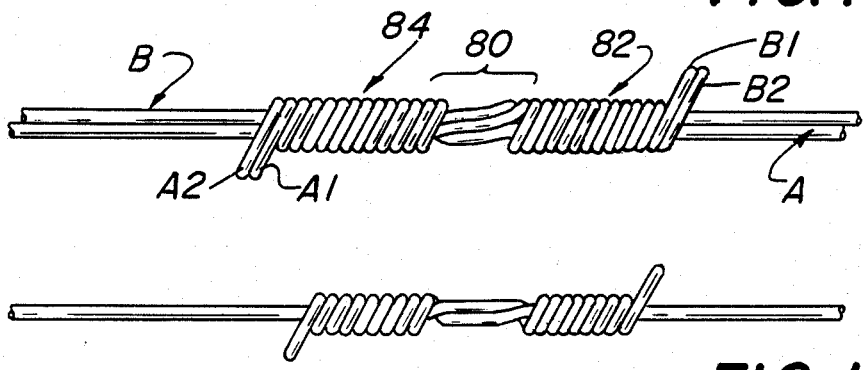
FIG. 11

WIRE SPLICING TOOL

BACKGROUND OF THE INVENTION

1. Field of the Invention

This invention relates to a wire splicing tool for splicing together the ends of single or multiple strand wires, such as the wire used for fence lines.

2. Description of the Prior Art

One type of wire splicing means includes wire splicing sleeves through which the ends of the wires are slid, after which the sleeves are crimped by a special wire splicing tool.

Another tool known in the art involves the use of a sleeve-like mechanism that joins the ends of the wires by means of its tapered jaws.

There are wire bending tools available that do not require the addition of a wire splicing sleeve. However, these tools are difficult to handle and, in use, involve wire splicing procedures that are cumbersome and time consuming.

There are also available wire splicing tools that apply a crimping action to overlapped wires.

SUMMARY OF THE INVENTION

The wire splicing tool of the invention is designed to obviate the problems of the present-day prior art devices and involves a pair of tool members adapted to be set in an interlocked position embracing a straight portion at the end of a first wire extending along a wire line and holding a turned portion at the end of a second wire extending along the wire line for winding the second wire turned portion around the first wire straight portion to effect a splicing action between the two wires. The wire splicing tool of the invention comprises two members which are inexpensive and identical in construction and which can be employed in a procedure which is very simple and involves a minimum amount of time.

More specifically, each of the tool members has a generally flat base and a flexible spring portion formed in the base and having a free end adapted to be flexed out of the plane of the base. Each tool member also includes an end portion turned to extend generally perpendicularly to the plane of the base, a cam portion on the base extending along the length of the base portion and a cam follower portion formed on the end portion. The cam follower portions of each of the tool members is adapted to ride on a cam portion on the other of the tool members. Each tool member also includes a wall means extending from the base in the same direction as the end portions thereof and adapted to hold the second wire turned portion during said winding thereof. The pair of tool members are constructed and arranged so that they can be placed in a first position with the end portions and bases thereof overlapping and facing toward each other and the free ends of the base portions of each tool member being in contact with an overlapping edge of an end portion of the other tool member. The parts are constructed and arranged such that when the pair of tool members are manually pulled in a direction so that the end portions move toward one another, the cam followers of each tool member ride on the cam portions of the other tool member to cause the free ends of the base portions to deflect away from the plane of their bases, said free ends of the base portions returning to the plane of the bases thereof when the end portions are moved beyond the ends of the free ends. The base portions of each tool member provide a stop in cooperation with the end portions of the other tool member to prevent separation of the tool members and retain said tool members in an interlocked position.

BRIEF DESCRIPTION OF THE DRAWINGS

FIG. 1 is a perspective view showing the two tool members positioned one over the other and about to be placed over the wire lines to be spliced.

FIG. 10 shows a double-wrapped splice for a two-strand wire line.

FIG. 11 shows a double wrapped splice for a single strand wire line.

DETAILED DESCRIPTION OF THE PREFERRED EMBODIMENT

Figure 2:
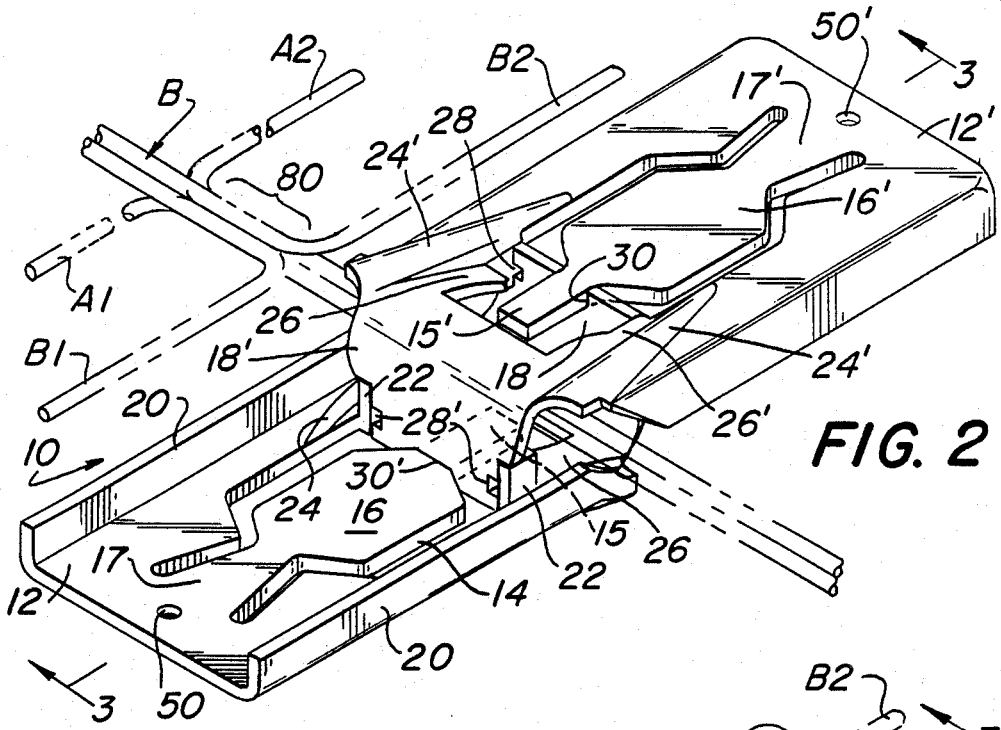
FIG. 2 is a perspective view showing the two tool members being placed in a first assembled position enclosing a straight portion of one of the wire lines to be spliced.

Referring to the Drawings, the wire splicing tool of the invention comprises a pair of tool members 10 and 10', which are identical in construction. Preferably, tool members 10 and 10' are made of a metal stamping as shown in the Drawings and, accordingly, are a one-piece construction. As is apparent from the Drawings, tool members 10 and 10' are symmetrical about the longitudinal axis thereof.

Since tool members 10 and 10' are identical in construction, the parts of tool member 10' corresponding to the parts of tool member 10 have been given the same reference numerals with primes added. A detailed description of tool member 10 is set forth hereafter, it being noted that tool member 10' has the identical parts wherefore a detailed description thereof is not deemed necessary for an understanding of the invention.

Tool member 10 comprises a flat generally rectangular base 12 having a cutout therein forming a flexible base portion 14 located centrally and symmetrically in base 12. As best shown in FIG. 1, base portion 14 has a narrow, straight free end portion 15 terminating near the forward end of base 12, a widened central portion 16, and a necked down, or narrow, portion 17 joined with base 12 at the rearward end of base 12. The free end portion 15 of the base portion 14 is adapted to be sprung out of the plane of the base 12 as base portion 14 flexes about its fixed end 17 for a purpose to be described more fully hereafter.

Figure 3:
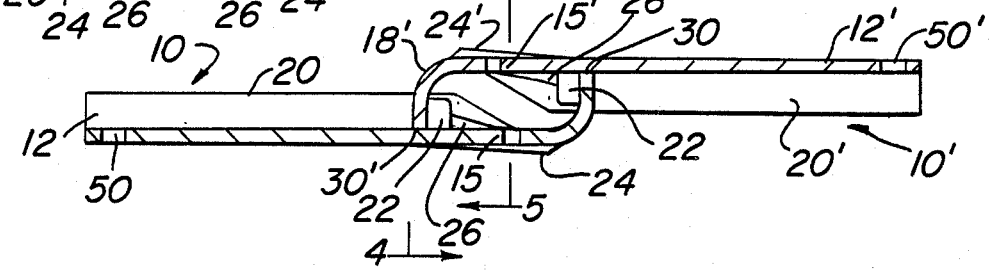
FIG. 3 is a sectional view taken on line 3—3 of FIG. 2.
Figure 5:
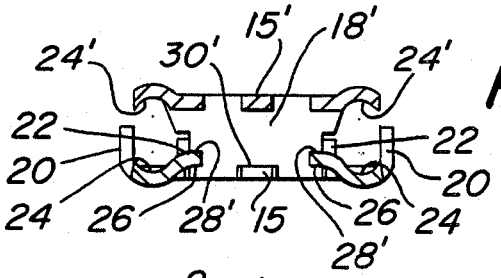
FIG. 5 is a sectional view taken on line 5—5 of FIG. 3.
Figure 7:
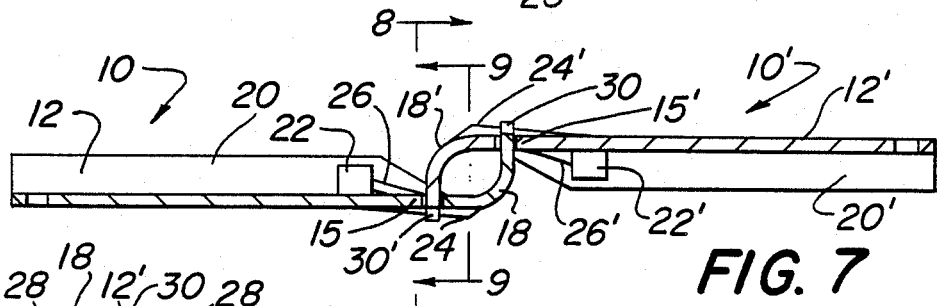
FIG. 7 is a sectional view taken on line 7—7 of FIG. 6.
Figure 8:
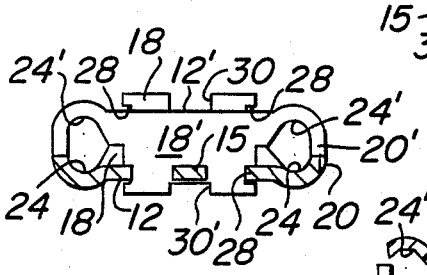
FIG. 8 is a sectional view taken on line 8—8 of FIG. 7.
Figure 9:
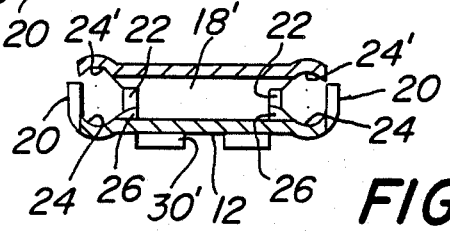
FIG. 9 is a sectional view taken on line 9—9 of FIG. 7.

At its forward end, tool member 10 is provided with an end portion 18 turned to extend generally perpendicularly to the plane of base 12. As is best shown in FIG. 3, the turned end portion 18 has an arcuate portion and a straight, or flat, portion at the terminal end thereof.

Extending upwardly from base 12 in the same direction as the end portion 18 are a pair of spaced apart parallel walls 20 extending perpendicularly to base 12 along the outer longitudinally extending edges of base 12, as is apparent from FIG. 1. Spaced inwardly from the walls 20 are a pair of tabs 22 located near the forward end of base 12. The tabs 22 and the walls 20 cooperate to provide a wall means adapted to hold the second wire turned end portion during a wire winding procedure as will be described more fully hereafter.

In the areas between the spaced apart walls 20 and tabs 22, base 12 is depressed to form a pair of trough-like portions 24 extending to the forward end of base 12. These trough-like portions 24 also form part of the wall means for holding the second wire turned portion during a winding procedure.

A pair of cam portions 26 are formed on base 12 at the forward end thereof. Each cam portion 26 extends forwardly from tab 22 in spaced apart opposed relation to free end portion 15 of base portion 14. As is shown in the Drawings, cam portions 26 extend from the tabs 22 to the beginning of the arcuate portion of end portion 18 at an angle to the plane of base 12. Each cam portion 26 projects inwardly toward the free end portion 15 of base portion 14 in the form of a ramp inclined downwardly as it extends toward the forward end of base 12.

End portion 18 is provided with a pair of cam follower portions adapted to ride on the cam portions 26 of another tool member, such as tool member 10'. To this end, a pair of rectangular recesses 28 are formed to extend laterally inwardly from the outer edges of the straight portion of turned end portion 18. The recesses 28 have a width slightly larger than the thickness of the ramps formed by cam portions 26 so that they can embrace the cam portions 26 during a cam following movement with a sliding fit there-between.

The outer edge of the straight portion of turned end 18 is provided with a centrally located recess 30 adapted to slidably receive the straight free end portion 15 of a cooperating tool member. The bottom wall of recess 30 serves as a positioning wall when the tool members 10 and 10' are placed in a first assembled position as shown in FIG. 2. In this position, the bottom wall of each recess 30, 30' is in contact with the cooperating free end portion 15, 15' to position the end portion 18 and 18' of each of the tool members 10 and 10' relative to the bases 12 and 12' of the other of the tool members 10 and 10'. In this first assembled position of the parts, i.e., the position of FIG. 2, the recesses 28 are aligned with the ends of cam followers 26 adjacent the tabs 22. This positioning enables the user of the splicing tool to place the cam follower recesses 28 in engagement with the cam portions 26 by manipulating the tool members 10, 10' through a separating movement.

Figure 6:
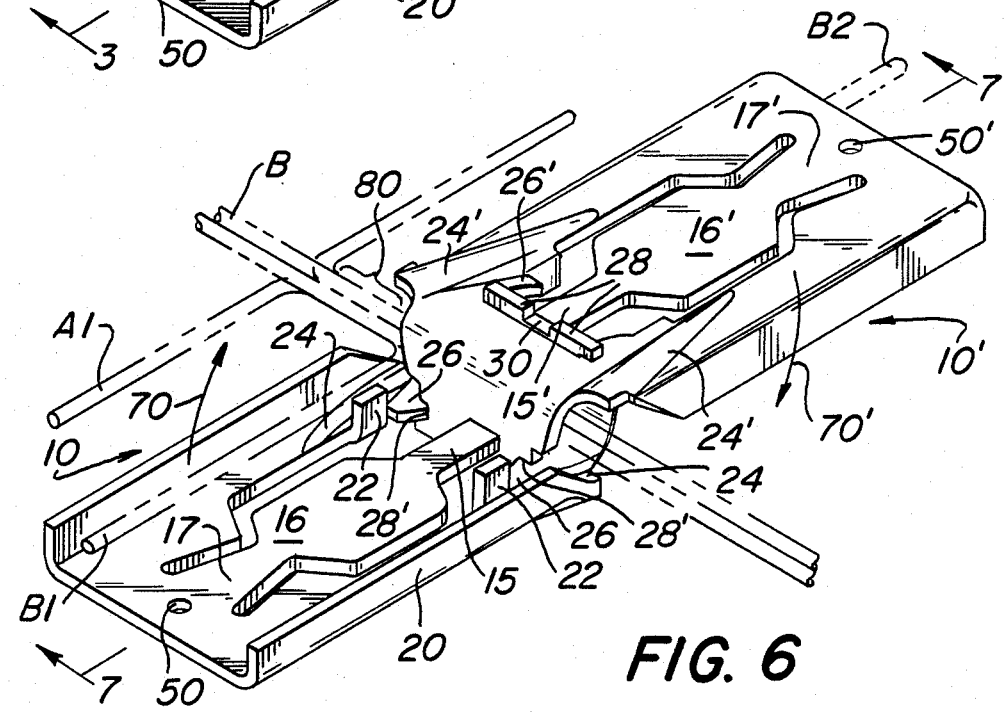
FIG. 6 is a perspective view showing the two tool members in the interlocked position thereof.
Figure 4:
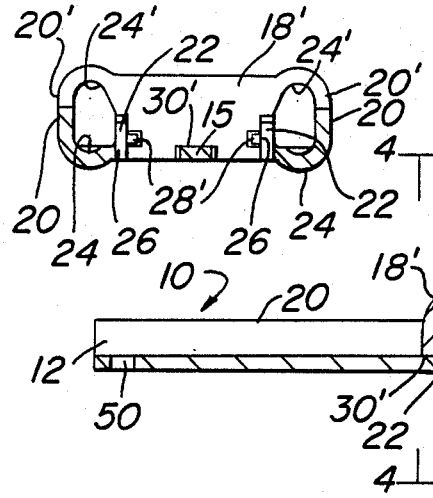
FIG. 4 is a sectional view taken on line 4—4 of FIG. 3.

The user of the splicing tool of the invention can position the tool members 10 and 10' in the first assembled position of FIG. 2 by overlapping the tool members 10 and 10' and inserting straight free end portion 15 in recess 30' and straight free end portion 15' in recess 30. In this first assembled position of the tool members 10, 10', the end portions 18, 18' of the bases 12, 12' thereof overlap and face toward each other and the free end portions 15, 15' of the base portions 14, 14' of each tool member 10, 10' are in contact with the bottom wall of a recess 30, 30' of an end portion 18, 18' of the other tool member 10, 10' such that when the pair of tool members 10 and 10' are manually pulled in a direction so that the end portions 18 and 18' move toward one another, the cam follower recesses 28, 28' of each tool member 10 and 10' ride on associated cam portions 26 or 26' of the other tool member. As the tool members 10, 10' are moved in this direction, the cam follower recesses 28, 28' cause the free end portions 15, 15' of the base portions 14, 14' to deflect away from the plane of their associated bases 12, 12'. However, when the end portions 18, 18' are moved beyond the forward ends of the free end portions 15, 15', the free end portions 15, 15' return to the plane of their associated bases 12, 12', which position is shown in FIG. 6. In this position of the tool members 10 and 10', the base portions 14, 14' of each tool member 10, 10' provide a stop in cooperation with the end portions 18, 18' of the other tool member 10, 10' to prevent a separation of the tool members 10, 10' and to retain said tool members 10, 10' in an interlocked position, i.e., the position shown in FIG. 6.

Circular holes 50, 50' are provided in the bases 12, 12' of tool members 10, 10' at the rearward portion thereof. Holes 50, 50' are of a size to receive a typical wire strand for manipulation thereof by the user of the tool members 10, 10'.

The manner in which the tool members 10 and 10' are used to splice together the ends of a pair of double-strand wires, such as the wires used in a fence line which has been broken, will be described with reference to FIGS. 1, 2 and 6.

The first step is to prepare the double-strand wires, indicated at A and B, for the splicing procedure. To this end, the wires A and B are placed in overlapping relationship and the four loose ends of wire are clamped together at the overlapping portions just back from the loose ends thereof. Referring to FIG. 2, the wires A and B would be clamped together in the overlapping region indicated at 80. The clamping can be achieved by means of any suitable clamping device, such as a "VISE-GRIP" plyers or a suitable clamp.

After the wires A and B have been securely clamped together at the overlapping region 80, the loose ends thereof are bent or turned perpendicularly to the fence line as shown in FIG. 2. The two turned ends of wire A are indicated at A1 and A2 and the two turned ends of wire B are indicated at B1 and B2.

The tool members 10 and 10' are then oriented as shown in FIG. 1 and placed above and below the straight portion of wire A as shown in FIG. 1. Next the tool members 10 and 10' are brought together at a first assembled position shown in FIG. 2 with the straight portion of wire A being contained in the passageway provided between the opposed end portions 18 and 18', as shown in FIG. 2. The wire A has now been captured between tool members 10 and 10' but the tool members 10 and 10' have not yet been interlocked.

The next step is to draw the tool members 10 and 10' through a separating movement to initially engage the cam follower recesses 28 and 28' on the ramps of cam portions 26 and 26' and then to pull the tool members 10 and 10' apart further so they snap into place in the interlocked position shown in FIG. 6. The straight portion of wire A is now firmly captured within the passageway provided by the interlocked tool members 10 and 10' between the end portions 18 and 18'.

The next step is to slide the interlocked tool members 10 and 10' along wire A toward the turned ends B1 and B2 of wire B and to position these turned ends B1, B2 in the position as shown in FIG. 6. More specifically, one turned end B1 is positioned between the wall 20 and tab 22 and to extend along the trough-like portion 24 so as to be held by this wall means of tool member 10. In a like manner, the other turned end B2 is positioned to be held by the wall means of tool member 10' between a wall 20' and an opposed tab 22' as it extends along the trough-like portion 24'.

The next step is to begin to turn the interlocked tool members 10 and 10' around the axis of wire A, the tool members 10 and 10' being rotated in a direction (shown by arrows 70 and 70' in FIG. 6) to cause the turned ends B1 and B2 of wire B to be wrapped around the straight portion of wire A. The tool members 10, 10' are designed so that the loose ends B1, B2 wrap themselves neatly around the straight portion of wire A to produce a wrap as shown at 82 in FIG. 10. The loose ends B1 and B2 will continue to wrap around wire A until they shorten to the extent that they are no longer received in the wall means of the associated tool members 10 and 10', the wrapping procedure typically resulting in very short ends being left over as is shown in FIG. 10.

After the first wrap is completed, the tool members 10 and 10' are unlocked by bending down the free ends 15 and 15' by pressing the thumb of one hand and the finger of the other on base portions 16 and 16' to allow the tool members to be moved through a movement opposite to the interlocking movement described above.

The next step is to move the unlocked tool members 10 and 10' to the other side of the clamping device and to capture the straight portion of wire B between end portions 18 and 18' at a location adjacent where the ends A1, A2 of wire A are turned perpendicularly. When this is achieved, the steps described above are repeated in the same manner causing the turned ends A1, A2 of wire A to be wrapped around the straight portion of wire B adjacent the overlapped clamped region 80. This action makes a double wrapped splice as shown in FIG. 10, the second wrap being indicated at 84.

In FIG. 11 there is shown a double-wrapped splice for a single strand of wire line as it would be produced by the use of the tool members 10 and 10' of the invention. The procedure for producing the splice shown in FIG. 11 is essentially the same as that described above except that only one turned end of each wire is wrapped around a straight portion of the other wire during each winding procedure.

This invention has been described by reference to precise embodiments but it will be appreciated by those skilled in the art that this invention is subject to various modifications and to the extent that those modifications would be obvious to one of ordinary skill they are considered as being within the scope of the appended claims.

What is claimed is:

1. A wire splicing tool for splicing together the ends of single or multiple strand wires, such as the wire used for fence lines, comprising:

a pair of tool members adapted to be set in an interlocked position embracing a straight portion near the end of a first wire extending along a wire line and holding a turned portion of the end of the second wire extending along the wire line for winding the second wire turned portion around the first wire straight portion, each of said tool members having a generally flat base having a longitudinal axis, a flexible base portion formed in said base intermediate the ends of said base and having a free end adapted to flex toward and away from the plane of said base, an end portion turned to extend generally perpendicularly to the plane of said base at the end of said base adjacent said free end, said turned up end portion being of a width less than that of said base, a cam portion on said base extending along the length of said base portion adjacent said free end, a cam follower portion formed on said end portion, and wall means extending from said base in the same direction as said end portion at the outer longitudinally extending edges thereof and adapted to hold the second wire turned portion during said winding thereof, said cam follower portion of each of said tool members being adapted to ride on a cam portion of the other of said tool members, said pair of tool members being constructed and arranged so that they can be placed in a first position with the end portions and bases thereof facing toward each other and the free ends of said base portions of each tool member being in contact with an overlapping edge of an end portion of the other tool member such that when said pair of tool members are manually pulled in a direction so that said end portions move toward one another, said cam followers of each tool member ride on said cams of the other tool member to cause the free ends of said base portions to deflect away from the plane of their bases, said free ends of said base portions returning to the plane of said bases thereof when said end portions are moved beyond the ends of said base portions, with the free ends of said base portions of each tool member providing a stop in cooperation with the end portions of the other tool member to prevent the separation of said tool members and to retain said tool members in said interlocked position.

2. A wire splicing tool according to claim 1 wherein said pair of tool members are identical in construction.

3. A wire splicing tool according to claim 2 wherein each of said tool members is of a one-piece construction.

4. A wire splicing tool according to claim 1 wherein each of said tool members comprises a pair of said cam portions, a pair of said cam follower portions and a pair of said wall means constructed and arranged symmetrically on opposite sides of the longitudinal axis of said base thereof.

5. A wire splicing tool according to claim 1 wherein said cam portion of each tool member includes an inclined ramp construction and said cam follower portion of each tool member includes a recess adapted to slidably engage said ramp construction.

6. A wire splicing tool according to claim 5 wherein said wall means of each tool member comprises a pair of spaced apart walls and a depressed portion of said base located between said spaced apart walls.

7. A wire splicing tool according to claim 6 wherein said free end of said flexible base portion has a straight configuration, said end portion having a recess therein adapted to slidably receive said free end of the other tool member.

8. A wire splicing tool according to claim 7 wherein each of said tool members has a circular hole in said base thereof adapted to receive a strand of said wire.

9. A wire splicing tool for splicing together the ends of single or multiple strand wires, such as the wire used for fence lines, comprising:

a pair of tool members adapted to be set in an interlocked position embracing a straight portion near the end of a first wire extending along a wire line and holding a turned portion of the end of the second wire extending along the wire line for winding the second wire turned portion around the first wire straight portion, each of said tool members having a generally flat base, an end portion turned to extend generally perpendicularly to the plane of said base, wall means extending from said base in the same direction as said end portion at the outer longitudinally extending edges thereof and adapted to hold the second wire turned portion during said winding thereof, and an interlocking means formed on said base and movable relative to said base, said interlocking means of each tool member being constructed and arranged to cooperate with the other tool member to secure said tool members in an interlocked position with the end portions thereof providing a passageway for receiving said straight portion of the first wire, said interlocking means being movable to a releasing position to permit said tool members to be separated from said interlocked position.

10. A wire splicing tool according to claim 9 wherein said interlocking means of each tool member comprises a flexible base portion formed in said base and intermediate the ends of said base and having a free end adapted to flex toward and away from the plane of said base, and wherein said free end of said flexible base portion has a straight configuration, said end portion having a recess therein adapted to slidably receive said free end of the other tool member.

11. A wire splicing tool according to claim 9 wherein said interlocking means comprises a flexible base portion formed in said base and intermediate the end of said base and having a free end adapted to flex toward and away from the plane of said base, a cam portion on said base extending along the length of said base portion adjacent said free end, and a cam follower portion formed on said end portion, said cam follower portion of each of said tool members being adapted to ride on a cam portion of the other of said tool members.

12. A wire splicing tool according to claim 11 wherein said pair of tool members are identical in construction and are constructed and arranged so that they can be placed in a first position with the end portions and the bases thereof facing toward each other and the free ends of said base portions of each tool member being in contact with an overlapping edge of an end portion of the other tool member such that when said tool members are pulled in a direction so that said end portions move toward one another, said cam followers of each tool member ride on said cam portions of the other tool member to cause the free ends of said base portions to deflect away from the plane of their bases, said tool members being constructed and arranged such that said free ends of said base portions return to the plane of said bases thereof when said end portions are moved beyond the ends of said base portions with said base portions of each tool member providing a stop in cooperation with the end portions of the other tool member to prevent the separation of said tool members and to retain said tool members in said interlocked position.

* * * * *